United States Patent [19]

Kawamura et al.

[11] Patent Number: 4,838,235

[45] Date of Patent: Jun. 13, 1989

[54] HEAT-INSULATING ENGINE STRUCTURE AND METHOD OF MANUFACTURING THE SAME

[75] Inventors: Hideo Kawamura, Kanagawa; Hiroshi Matsuoka, Yamato, both of Japan

[73] Assignee: Isuzu Motors Limited, Tokyo, Japan

[21] Appl. No.: 175,506

[22] Filed: Mar. 30, 1988

[30] Foreign Application Priority Data

Apr. 11, 1987 [JP] Japan ..... 62-87924

[51] Int. Cl.[4] ..... F02B 77/11

[52] U.S. Cl. ..... 123/668; 123/193 CH; 29/156.4 WL; 164/98

[58] Field of Search ..... 123/193 C, 193 CH, 193 H, 123/668, 669; 29/156.4 WL; 164/98, 103; 428/548, 621, 265, 266, 908.8, 920

[56] References Cited

U.S. PATENT DOCUMENTS

| | | | |
|---|---|---|---|
| 3,939,897 | 2/1976 | Kaneko et al. | 164/103 |
| 4,074,671 | 2/1978 | Pennila | 123/668 |
| 4,376,374 | 3/1983 | Bothwell | 123/668 X |
| 4,398,527 | 8/1983 | Rynbrandt | 123/668 |
| 4,526,824 | 7/1985 | Dworak et al. | 123/193 CH X |
| 4,676,064 | 6/1987 | Narita et al. | 123/193 H X |
| 4,738,227 | 4/1988 | Kamo et al. | 123/668 X |
| 4,774,926 | 10/1988 | Adams | 123/668 |

FOREIGN PATENT DOCUMENTS

| | | | |
|---|---|---|---|
| 3149775 | 6/1983 | Fed. Rep. of Germany | 123/668 |
| 3622301 | 1/1988 | Fed. Rep. of Germany | 123/668 |
| 0090955 | 5/1985 | Japan . | |

*Primary Examiner*—Willis R. Wolfe

*Attorney, Agent, or Firm*—Browdy and Neimark

[57] ABSTRACT

The heat-insulating engine structure according to the invention comprises fitting a ceramic head liner for which a cylinder liner top and a head lower surface portion are unified structurally in a cylinder head, coating an outer surface of the cylinder liner top of the head liner with a heat insulating laminate with a metallic sheet and a heat insulating material with potassium titanate as a principal component wound spirally by turns with a compressive force exerted thereon, thus enhancing strength or pressure resistance, forming a wall of the head liner as thin as possible to minimize a thermal capacity of the head liner, thereby enhancing suction efficiency and cycle efficiency. Further, heat insulation efficiency is enhanced all the more by disposing the heat insulating laminate having air layers between the head liner and the cylinder head. The manufacturing method for the heat insulating engine structure comprises heating the metallic sheet for thermal expansion, placing the heat insulating material on the metallic sheet, winding up spirally the metallic sheet on which the heat insulating material is placed to an outer peripheral surface of the cylinder liner top of the ceramic head liner, exerting a compressive force on the cylinder liner top by contraction of the metallic sheet thereafter, thereby ensuring the structure that withstands high pressures despite the thin-walled head liner.

15 Claims, 3 Drawing Sheets

HEAT-INSULATING ENGINE STRUCTURE AND METHOD OF MANUFACTURING THE SAME

BACKGROUND OF THE INVENTION

1. Field of the Invention

This invention relates to a heat-insulating engine structure and method of manufacturing the same in a ceramic engine and the like.

2. Description of the Prior Art

An engine member for heat-insulating engine and the like with a ceramic material utilized for heat insulating or resisting is disclosed hitherto, for example, in Japanese Patent Laid-Open No. 90955/1985. A heat-insulating engine structure disclosed in the publication will be described in outline with reference to FIG. 7. In FIG. 7, a heat-insulating engine structure is indicated generally by a reference numeral 30. The heat-insulating engine structure 30 comprises forming a surface of thermal reflection on an inner circumferential wall 33 of a cylindrical part 32 provided on lower half portion of a cylinder head 31, fitting a ceramic head liner 34 shaped like an inverted cup in the cylindrical part 32 of the cylinder head 31 with a void 35 left around. Then, a heat insulating material 36 such as ceramics fiber, glass fiber or the like is placed in the void 35 between the cylindrical part of the cylinder head 31 and the head liner 34. Further, an upper end wall of the head liner 34 is pushed to the inner end wall 33 of the cylindrical part 32 of the cylinder head 31 through a gasket 43, a lower end wall 42 of the head liner 34 is also pushed to upper end portions of a cylinder block 37 and a cylinder liner 39 through an elastic gasket 44, thus a stress concentration to be applied to the head liner 34 due to unbalance of tightening force and thermal deformation is relieved, and the void 35 is formed, therefore a heat conduction from the head liner 34 surrounding a combustion chamber 40 to a cylinder head 31 is cut off, and a heat dissipation can be suppressed. Further, a heat radiation is reflected on the surface of thermal reflection of the inner end wall 33, thus suppressing a heat conduction to the cylinder head 31. Furthermore, by placing a heat insulating material 36 such as ceramics fiber or the like and annular seal members 45, 46 in the void 35, an air convection in the void 35 is prevented, and a heat transfer from a wall portion of the head liner 34 to the cylinder head 31 can be suppressed. Accordingly, a heat of the combustion chamber 40 can be suppressed from being dissipated externally through the head liner 34, therefore hot exhaust gas can be sent to an exhaust turbo super-charger and others by way of the exhaust passage, thereby utilizing a thermal energy of the exhaust gas maximumly.

However, it is very difficult to secure a heat insulation characteristic thoroughly in the heat-insulating engine member such as cylinder head or the like with a ceramic material utilized for heat insulating or resisting as mentioned, and thus what is problematic is that a wall of the head liner 34 must be thickened inevitably so as to ensure a satisfactory heat insulation characteristic. That is, the portion facing the combustion chamber of an engine is constituted of ceramics such as silicon nitride or the like surpassing in heat resistance, heat insulating efficiency and heat shock resistance, to withstand a high-temperature combustion gas. However, if a wall of the head liner constituting the combustion chamber is too thick, then a thermal capacity becomes excessively large, and a deterioration of suction efficiency may result. Thus, problems remain as to how to construct the head liner for better suction efficiency and cycle efficiency while thinning a wall of the head liner constituting the combustion chamber in construction, minimizing a thermal capacity, and securing strength and pressure resistance of the head liner.

SUMMARY OF THE INVENTION

In solving the above-mentioned problem, an object of the invention is to provide a heat-insulating engine structure, wherein the wall of a ceramic head liner constituting a combustion chamber is made as thin as possible in construction, a thermal capacity of the head liner having high temperature and facing combustion chamber side is minimized, suction efficiency and cycle efficiency of an engine are enhanced thereby, and thus strength and pressure resistance of the head liner are enhanced.

Another object of the invention is to provide a heat-insulating engine structure characterized in that a head liner made of ceramics such as silicon nitride or the like with a lower surface of a cylinder head and an upper portion of a cylinder liner unified structurally therefor is fitted in the cylinder head, a heat insulating laminate for which a metallic sheet and a heat insulating material with potassium titanate as a principal component are wound up spirally by turns is disposed with a compressive force operating on an outer surface of the cylinder liner top of the head liner, thereby forming the head liner thin in wall thickness.

It is essential that a thermal capacity of the ceramic inside wall having high temperature be minimized so as to minimize the heat a heat-insulating engine receives from a cylinder inner wall, and hence a principal object of the invention is to provide a heat-insulating engine structure characterized in that a head liner is inserted in a cylinder head through a heat-insulating layer, the head liner is formed thin in wall thickness to minimize a thermal capacity, thus the wall surface is cooled down immediately to an optimum temperature of air at the time of admission, a difference between the sucked air temperature and the wall surface temperature is minimized, thus the sucked air is ready for flowing into a combustion chamber, then the quantity of heat absorbed into the wall surface is minimized at the time of maximum temperature in the combustion chamber, a difference between the combustion gas temperature and the wall surface temperature is minimized, thus minimizing a thermal energy escaping externally through cylinder head, cylinder block and others.

A further object of the invention is to provide a heat-insulating engine structure characterized in that a rigidity of the head liner is improved by a metallic sheet, a pressure resistance is also enhanced, further a heat insulation efficiency is enhanced by using a heat-insulating laminate with potassium titanate as a principal component, the heat insulation efficiency is also enhanced by causing a heat loss on thermal conduction through alternation of the metallic sheet and the heat insulating material wound up and so overlapped each other, further a surpassing heat insulation effect is obtained through an air layer formed on the heat insulating laminate.

An even further object of the invention is to provide a heat-insulating engine structure characterized in that the wall of a head liner is formed as thin as possible so as to minimize a thermal capacity thereof, a wound-up heat insulating laminate is placed in an annular groove formed on upper portion of a cylinder liner of the head liner and both end surfaces of the heat insulating laminate are not exposed, the heat insulating laminate will never come off the head liner, further an air layer is formed on the heat insulating laminate.

Another object of the invention is to provide a heat-insulating engine structure characterized in that the heat insulating laminate comprises a metallic sheet coated with a heat insulating material.

A further object of the invention is to provide a heat-insulating engine structure characterized in that the heat insulating material is a mixture of potassium titanate and organic binder, or a sheet having potassium titanate paper reinforced by alumina fiber on both upper and lower surfaces, or a sheet consisting of a mixture of potassium titanate whisker and alumina fiber, or is a mixture of foaming agent and potassium titanate whisker.

Then, the invention also relates to a manufacturing method for providing the aforementioned heat-insulating engine structure, and hence another object of the invention is to provide a manufacturing method for heat-insulating engine structure, wherein a metallic sheet is heated for thermal expansion on an outer peripheral surface of a head liner consisting of upper portion of a cylinder liner made of ceramics such as silicon nitride or the like and lower surface portion of a cylinder head, a heat insulating material is placed on the metallic sheet and wound up spirally, and then a compressive force can be operated simply on the head liner according to a contraction of the metallic sheet, thus obtaining a structure withstanding high pressure notwithstanding that a wall of the head liner is formed thin.

A further object of the invention is to provide a manufacturing method for heat-insulating engine structure characterized in that the metallic sheet is coated with a heat insulating material.

A further another object of the invention is to provide a manufacturing method for heat-insulating engine structure characterized in that the heat insulating material is constituted of a mixture of potassium titanate and organic binder and the mixture is applied onto the metallic sheet through a nozzle, thereby winding up to an outer surface of the head liner.

An even further object of the invention is to provide a manufacturing method for heat-insulating engine structure characterized in that the heat insulating material coming in a sheet is wound up to an outer surface of the head liner as placing the metallic sheet upon aforementioned sheet.

Another object of the invention is to provide a manufacturing method for heat-insulating engine structure characterized in that the heat insulating material is wound up to an outer surface of the head liner and then heated when the heat insulating material is a mixture of foaming agent and potassium titanate whisker.

In another object of the invention, a thermal energy will not be retained on the head liner at expansion stroke or exhaust stroke, that is to say, the thermal energy will not remain in a combustion chamber, and the thermal energy can be fed almost all into an energy recovery device provided downstream by way of an exhaust port.

DETAILED DESCRIPTION OF THE EMBODIMENTS

A preferred embodiment of the heat-insulating engine structure according to the invention will now be described with reference to the accompanying drawings.

Figure 1:
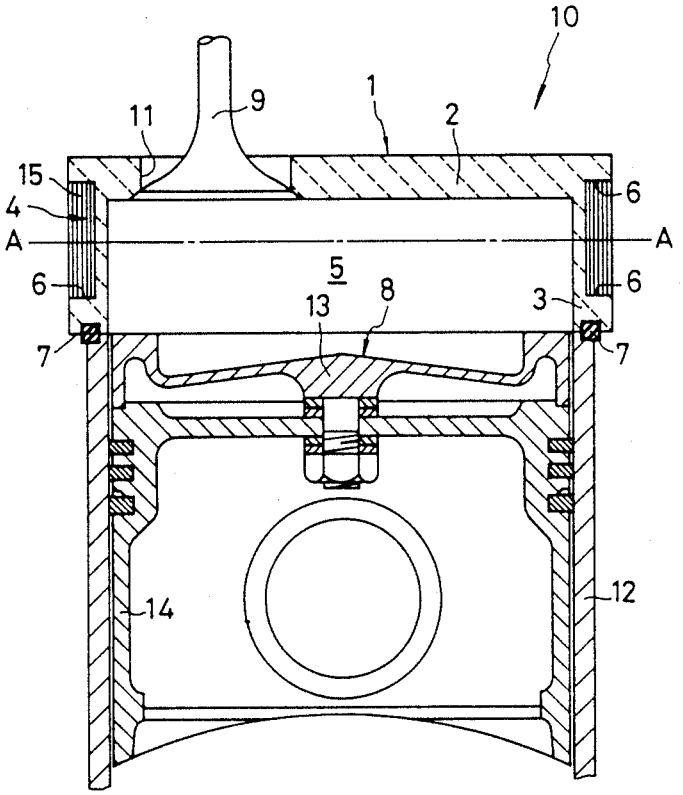
FIG. 1 is a sectional view representing one embodiment of a heat-insulating engine structure according to the invention.

In FIG. 1, a heat-insulating engine structure given in one embodiment of the invention is indicated generally by a reference numeral 10. In regard to the heat-insulating engine structure 10, only a technical conception on the heat-insulating structure of a cylinder head in the heat-insulating engine is disclosed, and a heat-insulating structure on a cylinder liner 12, a piston 8 and a suction-/exhaust valve 9 of the portions other than the above-mentioned is not disclosed, however, in regard to the heat-insulating engine, it can be attained securely further, needless to say, by constructing these cylinder liner, piston and suction/exhaust valve of ceramics such as silicon nitride or the like, heat-insulating seal material and so forth to form a heat insulating structure.

Figure 7:
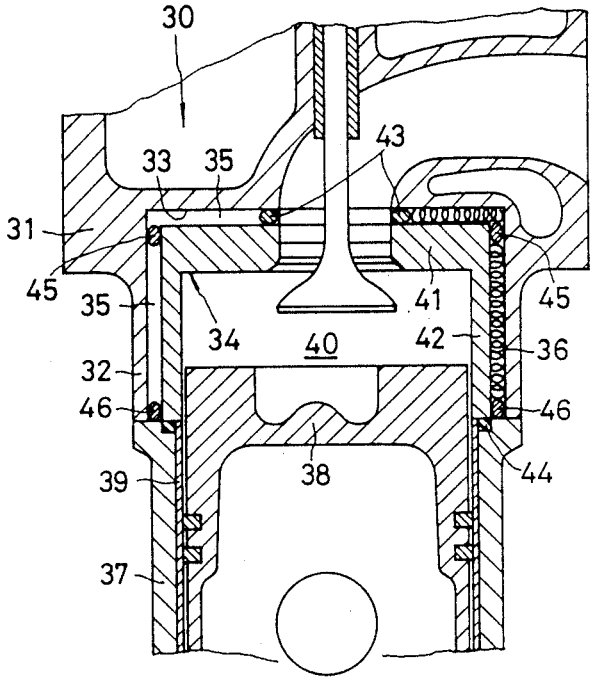
FIG. 7 (Prior art)
FIG. 7 is a sectional view showing a prior art heat-insulating engine structure.

In the heat-insulating engine structure 10 according to the invention, a head liner 1 made of ceramics such as silicon nitride or the like is formed such that a cylinder head lower surface portion 2 and a cylinder liner top 3 are unified in construction, further, a wall of the head liner 1 is formed as thin as possible, and a thermal capacity of the head liner 1 is minimized. The head liner 1 is disposed to face a combustion chamber 5 and fitted, as shown in FIG. 7, for example, in a cylindrical part of the cylinder head through a heat insulating layer consisting of air layer, heat insulating material or the like. Then, the cylinder liner top 3 of the head liner 1 is connected to the cylinder liner 12 through a gasket 17. The piston 8 consisting of a piston head 13 and a piston skirt 14 is disposed for reciprocation in the cylinder liner 12 and the cylinder liner top 3. A suction/exhaust port 11 (one only being indicated) is formed on the head liner 1, and the suction/exhaust valve 9 is disposed on the suction/exhaust port 11. As illustrated, an annular groove 6 is formed on an outer peripheral surface of the cylinder liner top 3 in the head liner 1, thereby forming a wall of the cylinder liner top 3 as thin as possible. A heat insulating laminate 4 is placed in the annular groove 6, and the heat insulating laminate 4 is disposed so as not to protrude from a maximum diametrical plane of the cylinder liner top 3 at its both end surfaces. The heat insulating laminate 4 comprises a metallic sheet 15 wound up spirally thereon and a heat insulating material 19 with potassium titanate as a principal component interposed between the metallic sheets 15. That is to say, the construction is such that the annular groove 6 formed on an outer peripheral surface of the cylinder liner top 3 made of ceramics such as silicon nitride or the like is wound up and so covered with the heat insulating laminate 4. Further, a wall of the cylinder liner top 3 is formed as thin as possible so as to minimize a thermal capacity of the head liner 1.

As described above, the heat-insulating engine structure according to the invention is such that the outer peripheral surface of the cylinder liner top 3 in the head liner 1 made of ceramics is covered by the heat insulating laminate 4, therefore the cylinder liner top 3 itself is formed to a structure surpassing in heat insulation efficiency and pressure resistance, and further the wall of the head liner 1 is formed thin to minimize a thermal capacity, thereby enhancing suction efficiency and cycle efficiency of the engine.

Figure 2:
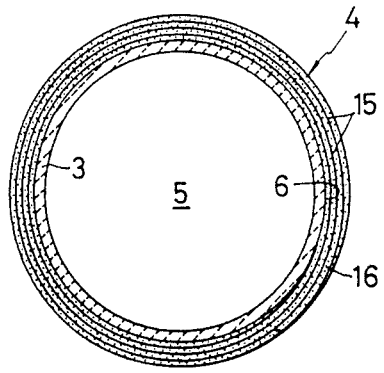
FIG. 2 is a sectional view taken on line A—A of FIG. 1.
Figure 3:
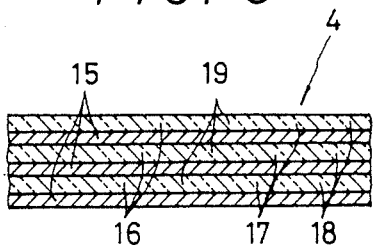
FIG. 3 is a fragmentary enlarged sectional view of FIG. 2.

Next, the heat insulating laminate 4 wound up to the outer peripheral surface of the cylinder liner top 3 is exemplified in detail with reference to FIG. 2 and FIG. 3. FIG. 2 is a sectional view taken on line A—A of FIG. 1, and FIG. 3 is a fragmentary enlarged sectional view of FIG. 2. The heat insulating laminate 4 comprises building up the heat insulating material 19 and the metallic sheet 15 alternately or winding up each other. Then, a multiplicity of air layers 18 are formed on a contact surface of the heat insulating material 19 and the metallic sheet 15 and also within the heat insulating material 19. As a material for the metallic sheet 15, those with a coefficient of thermal expansion almost approximate to silicon nitride which is a material of the head liner 1, namely, cover (fernico: Fe-Ni-Co group alloy), inconel (nickel alloy), 42 alloy and the like will be preferable. Then, the heat insulating material 19 is constituted of a mixture of potassium titanate whisker 16 at about 80% as a principal component and alumina fiber 17 at about 20% as an auxiliary component, fibers of the whisker and the alumina fiber are not continuous, and the multiplicity of air layers 18 are formed therein, thus obtaining a further surpassing heat insulation effect. Potassium titanate is, for example, a whiskery potassium titanate ($K_2Ti_6O_{13}$, fusing point 1,370° C., specific gravity 3.2, thermal conductivity 0.00012 cal/cm sec ° C.).

Then, the heat insulating laminate 4 has various constructions in a built-up state of the metallic sheet 15 and the heat insulating material 19. That is, the heat insulating laminate 4 assumes constructions in which, for example, the metallic sheet 15 is coated with the heat insulating material 19 and then wound up, the heat insulating material 19 is constructed in a papery state from mixing an organic binder with potassium titanate whisker as a principal component and the metallic sheet 15 are built one upon another, the heat insulating material 19 reinforced by sandwiching a sheet constructed in a papery state from mixing an organic binder with potassium titanate whisker 16 as a principal component between alumina fiber sheets and the metallic sheet 15 are built one upon another, a strength is enhanced by building the heat insulating material 19 constructed in a papery state from mixing the alumina fiber 17 which is an alumina short fiber with potassium titanate whisker 16 as a principal component and the metallic sheet 15 one upon another, the heat insulating material 19 constructed from mixing a foaming agent in potassium titanate whisker and the metallic sheet 15 are built one upon another, and so forth.

Figure 4:
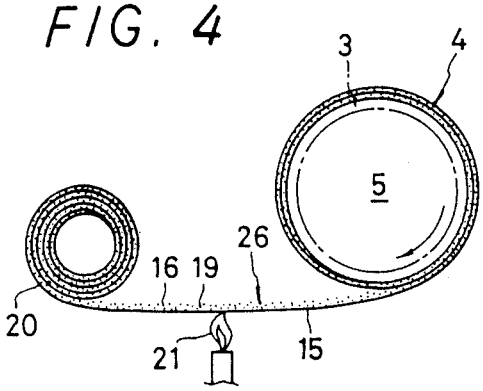
FIG. 4 is a schematic view for illustrating one embodiment of a manufacturing method for heat-insulating engine structure according to the invention.
Figure 5:
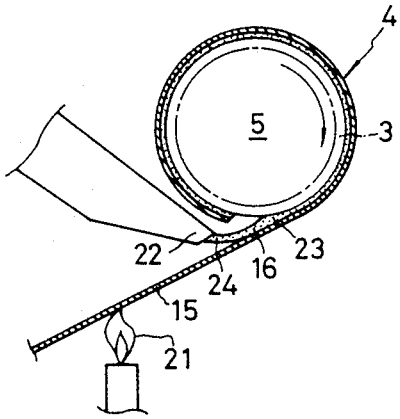
FIG. 5 is a schematic view for illustrating another embodiment of the manufacturing method for heat-insulating engine structure according to the invention.
Figure 6:
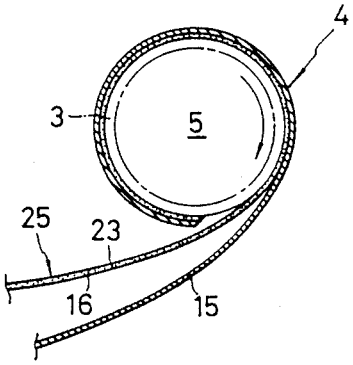
FIG. 6 is a schematic view for illustrating a further embodiment of the manufacturing method for heat-insulating engine structure according to the invention.

Next, a manufacturing method for the heat-insulating engine structure according to the invention will be described in detail with reference to FIG. 4, FIG. 5 and FIG. 6. The manufacturing method for the heat-insulating engine structure comprises winding up a sheet consisting of the metallic sheet 15 and the heat insulating material 19 in the annular groove 6 formed on the cylinder liner top 3 of the head liner 1 made of ceramics such as silicon nitride or the like.

First, one embodiment of the manufacturing method for the heat-insulating engine structure will be described with reference to FIG. 1 and FIG. 4. A sheet obtained through coating the metallic sheet 15 with the heat insulating material 19 with potassium titanate 16 as a principal component is delivered from a roll 20, and the delivered sheet is heated on a heater 21 to keep the metallic sheet 15 expanded thermally. Next, a heated sheet 26 is placed spirally and wound up on an outer surface of the annular groove 6 formed on the cylinder liner top 3 of the head liner 1 made of ceramics such as silicon nitride or the like, and finally an end portion of the metallic sheet 15 in the sheet 26 is fixed on the metallic sheet 15 positioned inside through a spot welding or other process, thereby providing the heat insulating laminate 4 on an outer peripheral surface of the cylinder liner top 3. After the sheet 26 is wound up, the metallic sheet 15 contracts, thus the heat insulating laminate 4 exerting a compressive force on the cylinder liner top 3. Consequently, the cylinder liner top 3 and the head liner 1 accordingly can be framed to withstand high pressures.

Next, another embodiment of the manufacturing method for the heat-insulating engine structure will be described with reference to FIG. 1 and FIG. 5. In regard to the manufacturing method for the heat-insulating engine structure, the heat insulating material 19 is a viscous mixture 24 obtained through mixing potassium titanate 16 with an organic binder 23, the mixture 24 is applied onto the metallic sheet 15 from a nozzle 22 and then wound up, thus disposing the heat insulating laminate 4 on an outer peripheral surface of the cylinder liner top 3. Other respects are similar to the above-described embodiment, therefore a description will not be given repeatedly thereof.

Then, a further embodiment of the manufacturing method for the heat-insulating engine structure will be described with reference to FIG. 1 and FIG. 6. The embodiment refers to a case where the heat insulating material 19 is a sheet 25, which comprises winding up the sheet 25 and the metallic sheet 15 while placing one upon the other, thus providing the heat insulating laminate 4 on an outer peripheral surface of the cylinder liner top 3. The sheet 25 comes in a heat insulating material reinforced by sandwiching a sheet formed in a papery state from mixing the organic biner 23 with potassium titanate whisker 16 as a principal component between alumina fiber sheets, a heat insulating material (FIG. 3) formed in a papery state from mixing the alumina fiber 17 which is an alumina short fiber with potassium titanate whisker 16 as a principal component, and so forth. Since other respects are similar to the above-described first embodiment, a further description will be omitted thereof.

While not particularly illustrated, an even further embodiment of the manufacturing method for the heat-insulating engine structure will be described. The embodiment refers to a case where the heat insulating material is obtained through mixing a foaming agent in potassium titanate whisker. The method comprises winding up a head insulating laminate consisting of the heat insulating material and the metallic sheet to an outer peripheral surface of the cylinder liner top 3, heating the heat insulating laminate thereafter.

What is claimed is:

1. A heat-insulating engine structure, comprising:

a cylinder head lower surface portion having a suction/exhaust port thereon and consisting of a ceramic material such as silicon nitride or the like;

a cylinder liner top connected to a cylinder liner through a gasket and consisting of a ceramic material such as silicon nitride or the like;

a head liner for which said cylinder head lower surface portion and said cylinder liner top are unified structurally; and a cylinder head having a cylindrical part in which said head liner is fitted; wherein, a heat insulating laminate is constructed by winding up alternately and spirally the metallic sheet and a heat insulating material with potassium titanate as a principal component;

said heat insulating laminate being disposed on an outer peripheral surface of said cylinder liner top of said head liner with a compressive force exerted thereon.

2. The heat-insulating engine structure as defined in claim 1, wherein walls of said cylinder liner top and said cylinder head lower surface portion are formed as thin as possible, and a thermal capacity of said head liner is minimized.

3. The heat-insulating engine structure as defined in claim 1, wherein said wound-up heat insulating laminate is placed in an annular groove formed on the outer peripheral surface of said cylinder liner top of said heat liner, and both end surfaces of said heat insulating laminate are not protrudent from a maximum diametrical plane of said cylinder liner top.

4. The heat-insulating engine structure as defined in claim 1, wherein air layers are formed in said heat insulating laminate.

5. The heat-insulating engine structure as defined in claim 1, wherein said heat insulating laminate comprises said metallic sheet coated with said heat insulating material.

6. The heat-insulating engine structure as defined in claim 1, wherein said heat insulating material is a mixture of potassium titanate and organic binder.

7. The heat-insulating engine structure as defined in claim 1, wherein said heat insulating material is a sheet with both surfaces of a potassium titanate paper reinforced by an alumina fiber.

8. The heat-insulating engine structure as defined in claim 1, wherein said heat insulating material is a sheet consisting of a mixture of a potassium titanate whisker and an alumina fiber.

9. The heat-insulating engine structure as defined in claim 1, wherein said heat insulating material comprises mixing a foaming agent in a potassium titanate whisker.

10. The heat-insulating engine structure as defined in claim 1, wherein said heat liner is fitted in said cylinder head through air layers and a heat insulating layer such as insulating material or the like.

11. A manufacturing method for heat-insulating engine structure, comprising:

a head liner for which a cylinder head lower surface portion consisting of a ceramic material such as silicon nitride or the like and a cylinder liner top consisting of a ceramic material such as silicon nitride or the like are unified structurally is formed;

a metallic sheet is heated for thermal expansion, and a heat insulating material is placed and so disposed on said metallic sheet;

said metallic sheet on which said heat insulating material is placed is wound up spirally to an outer peripheral surface of said cylinder liner top of said head liner;

a compressive force is exerted on said cylinder liner top by contraction of said metallic sheet after said metallic sheet is wound up.

12. The manufacturing method for heat-insulating engine structure as defined in claim 11, wherein said metallic sheet is coated with said heat insulating material.

13. The manufacturing method for heat-insulating engine structure as defined in claim 11, wherein said heat insulating material is constituted of a mixture of potassium titanate and organic binder, said mixture is applied onto said metallic sheet from a nozzle.

14. The manufacturing method for heat-insulating engine structure as defined in claim 11, wherein said heat insulating material is formed into a sheet, said sheet and said metallic sheet are wound up while being placed one upon the other.

15. The manufacturing method for heat-insulating engine structure as defined in claim 11, wherein said heat insulating material is formed by mixing a foaming agent in a potassium titanate whisker, said heat insulating material is wound up on said cylinder liner top and then heated.

* * * * *